US006422144B1

(12) United States Patent
Izume

(10) Patent No.: US 6,422,144 B1
(45) Date of Patent: Jul. 23, 2002

(54) INK FEED DEVICE WITH VIBRATING ROLLERS

(75) Inventor: Masayuki Izume, Kyoto (JP)

(73) Assignee: I. Mar Planning Inc., Kyoto (JP)

( * ) Notice: Subject to any disclaimer, the term of this patent is extended or adjusted under 35 U.S.C. 154(b) by 0 days.

(21) Appl. No.: 09/673,322

(22) PCT Filed: Jul. 27, 1999

(86) PCT No.: PCT/JP99/04018

§ 371 (c)(1),
(2), (4) Date: Oct. 13, 2000

(87) PCT Pub. No.: WO00/27637

PCT Pub. Date: May 18, 2000

(30) Foreign Application Priority Data

Nov. 9, 1998 (JP) ..... 10/317240

(51) Int. Cl.[7] ..... B41F 31/15
(52) U.S. Cl. ..... 101/350.3; 101/DIG. 32
(58) Field of Search ..... 101/350.3, 352.06, 101/351.1, 351.2, 351.4, 352.01, 352.05, DIG. 32

(56) References Cited

U.S. PATENT DOCUMENTS 4,632,029 A * 12/1986 Simeth ..... 101/348
4,987,831 A * 1/1991 Weder ..... 101/350.1
5,383,394 A * 1/1995 Izume ..... 101/350.3
5,688,217 A * 11/1997 Izume ..... 492/39

FOREIGN PATENT DOCUMENTS

JP 60-38160 2/1985
JP 06071862 A * 3/1994 ..... B41F/31/14
JP 06071863 A * 3/1994 ..... B41F/31/14
JP 09141833 A * 6/1997 ..... B41F/31/14
JP 10244661 A * 9/1998 ..... B41F/31/26

* cited by examiner

*Primary Examiner*—Daniel J. Colilla
(74) *Attorney, Agent, or Firm*—Armstrong, Westerman & Hattori, LLP

(57) ABSTRACT

An inking arrangement for printing presses which comprises a plurality of vibrating rollers switchable between two positions between a fountain roller and a distributing roller. A support member, has fitted therearound a plurality of movable members each formed with a rectangular bore having the support member inserted therethrough with a clearance provided in the bore in the forward or rearward widthwise direction of the support member. The vibrating rollers are rotatably mounted on the respective movable members. Change-over devices are provided between the support member and the movable members for moving the movable members by controlling a supply of air with switching valves. A surface of each movable member defining the rectangular bore and a surface of the support member are formed with opposed grooves, in which the switching valve is mounted on the bottom surface of the groove of the support

5 Claims, 5 Drawing Sheets

INK FEED DEVICE WITH VIBRATING ROLLERS

TECHNICAL FIELD

The present invention relates to inking arrangements for use in printing presses, and more particularly to an inking arrangement for printing presses which comprises a fountain roller, a distributing roller and a plurality of vibrating rollers divided axially of the rollers and arranged therebetween, the vibrating rollers being individually switchable back and forth between two positions between the fountain roller and the distributing roller so as to differ in the mode of contact thereof with these two rollers alternately.

BACKGROUND ART

For use printing presses, inking arrangements of such type are already known wherein each vibrating roller is rotatably attached to the movable ends of pivotal arms, and the pivotal arms are moved as by pneumatic cylinder or like means to switch the vibrating roller back and forth between a first position where the roller is in contact with the fountain roller and away from the distributing roller and a second position where the roller is in contact with the distributing roller and away from the fountain roller.

However, the conventional inking arrangement described requires pairs of pivotal arms for switching the vibrating rollers between the two positions to result in the problem of necessitating a great installation space.

To solve this problem, an inking arrangement is proposed which comprises a support member in the form of a rectangular pipe and disposed in parallel to a fountain roller and a distributing roller, a plurality of short cylindrical movable members fitted around the support member, each of the movable members being formed with a rectangular bore having the support member inserted therethrough with a clearance provided in the direction of one width of the support member, vibrating rollers rotatably mounted on the respective movable members externally thereof, and change-over devices provided on the support member and positioned between the support member and the respective movable members for moving the movable member in the above-mentioned direction of width of the support member, each by an electromagnet and a spring, to switch the vibrating rollers individually between different positions. (see JP-A No. 38160/1985).

With this arrangement, the position of the movable member is changed by energizing or deenergizing the coil of the electromagnet of the change-over device. When the coil of the electromagnet is not energized, the movable member is located in the first position by the biasing force of the spring, while when the coil is energized, the movable member is shifted to the second position by the magnetic drive force of the electromagnet.

The arrangement nevertheless has a problem attributable to the generation of heat of the electromagnet of the change-over device as will be described below. The spring has a considerably great biasing force since the spring moves a considerably great portion comprising the movable member and the vibrating roller to press the vibrating roller into contact with the fountain roller or distributing roller. A great magnetic drive force is required of the electromagnet because the electromagnet is adapted to press the vibrating roller into contact with the distributing roller or fountain roller by moving the great portion against the biasing force of the spring. Accordingly, a sufficient drive force is not available unless the electromagnet is large-sized, and an increase in the size of the electromagnet makes the change-over device greater in size. Although the coil of the electromagnet generates a large quantity of heat, the electromagnet is disposed in the support member inside the bore of the movable member and is therefore unable to dissipate the heat, greatly raising the temperature of the electromagnet and the support member. This entails the likelihood that the coil of the electromagnet will be thermally damaged, or the support member will expand thermally, no longer permitting the movable member to move smoothly relative to the support member. It is necessary to provide a cooling device to preclude this drawback, whereas the change-over device then becomes complex in construction and greater in size.

Accordingly, the foregoing publication proposes an arrangement which comprises a plurality of movable members each in the form of a short hollow cylinder and fitted around a support member in the form of a round tube so as to be movable along one diametrical direction of the support member, and a change-over device comprising a cylinder provided inside the support member and having a piston in the cylinder portion, and a spring. The movable members are movable along the diametrical direction of the support member, each by the piston and the spring, to switch the vibration rollers individually between different positions.

With this arrangement, the movable member is switched between the different positions by controlling the supply of air to the cylinder portion of the change-over device with a switching valve. When no air is supplied to the cylinder portion, the movable member is switched to the first of the positions by the biasing force of the spring, while when air is supplied to the cylinder portion, the movable member is switched to the second of the positions by the biasing force of the piston.

As will be described below, however, this arrangement has the problem that the change-over device is composed of a large number of parts, difficult to assemble and cumbersome to maintain, requires a large installation space, great air consumption and a prolonged response time in changing the position of the vibration roller. Stated more specifically, aside from the support member, each ink transfer roller requires one cylinder, and also piping between the cylinder and each switching valve and piping between each switching valve and a compressed air source, hence an increased number of parts. Also required are work for mounting the cylinders in the interior of the support member, work for piping between each cylinder and each switching valve, work for the piping between the switching valve and the compressed air source, difficult assembling work and cumbersome maintenance work. The switching valves are arranged externally of the support member since it is impossible to provide the valves inside the support member which has in its interior the cylinders and the piping between the compressed air source and the cylinders. Accordingly there is a need to provide a large space for the installation of the switching valves externally of the ink transfer rollers. This requires elongated piping between the cylinders provided inside the support member and the switching valves arranged outside the support member, consequently necessitating greatly increased air consumption when air is supplied to each cylinder portion and an increased period of time until the piston actually moves the movable member after the switching valve is controlled, i.e., a prolonged response time in changing the position of the ink transfer roller. Further because the distance between the cylinder and the switching valve generally differs from cylinder to cylinder, the length of the piping differs from cylinder to cylinder if the piping is installed in the usual manner, with the result that the response time in changing the position of the ink transfer roller varies from roller to roller. To avoid this, the pipes between the cylinders and the respective switching valves need to have equal lengths, whereas it is then necessary to give each pipe the same length as the longest pipe to entail a need for correspondingly excessive piping and additional installation space.

Accordingly, we have proposed an inking arrangement which comprises a support member in the form of a prism, movable members each having a groove extending over the entire length thereof and formed in a surface thereof slidable in contact with the support member and defining a rectangular bore, and switching valves each positioned in the groove and mounted on the support member on the surface thereof facing the groove of the movable member, the support member being bored to provide cylinder portions, the support member being internally formed with a common air supply channel extending through the support member axially thereof and communicating at one end thereof with a compression air supply source, a plurality of communication passageways each holding the air supply channel in communication with the switching valve, and a plurality of communication passageways each holding the switching valve in communication with the cylinder portion (see JP-A No. 71863/1994).

The support member and the switching valve need to be provided inwardly of the outer periphery of the movable member in the case of this arrangement, whereas since the support member only is present with respect to the direction of movement of the movable member, the support member can be given an increased width in this direction. However, the support member and the switching valve are present with respect to a direction orthogonal to this direction, so that the width of the support member can not be increased in the second-mentioned direction. This gives diminished flexural rigidity to the support member in its entirety, failing to press the ink vibrating roller into contact with the fountain roller or distributing roller with a great pressure.

An object of the present invention is to overcome the foregoing problems and to provide an inking arrangement for printing presses comprising a change-over device which is reduced in installation space, diminished in the number of components, easy to assemble and maintain, decreased in air consumption, shortened in response time in changing the position of the vibrating roller and capable of giving increased flexural rigidity to the support member.

DISCLOSURE OF THE INVENTION

The present invention provides an inking arrangement for printing presses which comprises a fountain roller and a distributing roller supported by a frame so as to be parallel to each other, and a plurality of vibrating rollers divided axially of these rollers and arranged at an interval axially thereof between the rollers, the vibrating rollers being individually switchable between two positions between the fountain roller and the distributing roller so as to differ in the mode of contact thereof with the rollers, the inking arrangement further comprising a support member in the form of a prism and secured to the frame so as to be parallel to the fountain roller and the distributing roller, a plurality of short cylindrical movable members fitted around the support member, each of the movable members being formed with a rectangular bore having the support member inserted therethrough with a clearance provided in the bore in the direction of one width of the support member, the vibrating rollers being rotatably mounted on the respective movable members externally thereof, and change-over devices provided on the support member and positioned between the support member and the respective movable members for moving the respective movable members along said direction of width of the support member to switch the vibrating rollers individually between said positions, each of the change-over devices comprising a piston slidably inserted in a cylinder portion for pneumatically biasing the movable member toward one side in said width direction, a spring for biasing the movable member toward the other side in said width direction, and a switching valve having an inlet port, an outlet port and an exhaust port communicating with a compressed air source, the cylinder portion and the atmosphere respectively for controlling supply of air to the cylinder portion when changed in the energization state thereof, the movable member being switchable to said one side in the width direction by the biasing force of the piston when air is supplied to the cylinder portion, the movable member being switchable to said other side in the width direction by the biasing force of the spring when no air is supplied to the cylinder portion, the inking arrangement being characterized in that each of the movable members has a groove extending over the entire length thereof and formed in a surface thereof slidable in contact with the support member and defining the rectangular bore, the support member having a groove formed in a surface thereof opposed to the groove of the movable member, the switching valve being positioned in the grooves and mounted on the support member on a bottom surface defining its groove and facing the groove of the movable member, the support member being bored to provide the cylinder portion, the support member being internally formed with a common air supply channel extending through the support member axially thereof and communicating at one end thereof with the compression air supply source, a plurality of communication passageways each holding the air supply channel in communication with the inlet port of the switching valve, and a plurality of communication passageways each holding the outlet port of the switching valve in communication with the cylinder portion.

Thus, each of the movable members has a groove extending over the entire length thereof and formed in a surface thereof slidable in contact with the support member and defining the rectangular bore, the support member has a groove formed in a surface thereof opposed to the groove of the movable member, and the switching valve is positioned in the grooves and mounted on the support member on a bottom surface defining its groove and facing the groove of the movable member. Accordingly, the electric wires for each switching valve can be passed through the grooves to extend to the outside. Further the support member in the form of prism is internally formed with a common air supply channel communicating with the compression air supply source, a plurality of communication passageways each holding the air supply channel in communication with the inlet port of the switching valve, and a plurality of communication passageways each holding the outlet port of the switching valve in communication with the cylinder portion. Accordingly, the air supply channel formed in the support member needs only to communicate at its one end with the compressed air source. Except for the wiring for the switching valves and the piping between the air supply channel of the support member and the air source, the change-over devices are arranged predominantly inside the ink transfer rollers. This eliminates the need for a great space for installing the change-over devices externally of the ink transfer rollers, rendering the devices installable in a reduced space.

The support member in the form of a prism is bored to provide each cylinder portion. This obviates the need to provide a cylinder separately. The piping needed is only between the air supply channel of the support member and the compressed air source as described above, while there is no need for the piping between each cylinder portion and each switching valve, and there is little or no need for the piping between the switching valve and the compressed air source. Consequently, the change-over device is much smaller than in the prior art in the number of components. There is no need for the work for installing cylinders in the support member, work for piping between each cylinder portion and the corresponding switching valve, and work for piping between the switching valves and the air source. The change-over device is therefore easy to assemble and maintain.

The support member is provided, at the portion thereof where each ink transfer roller is positioned, with the switching valve for the transfer roller and also with the cylinder portion and the passageway holding the outlet port of the valve in communication with the cylinder portion. This greatly shortens the length of the passageway communicating with the cylinder portion. The passageways communicating with the respective cylinder portions and provided for the respective ink transfer rollers can all be made to have equal lengths. The reduction in the length of the passageways leading to the cylinder portions results in decreased air consumption when air is supplied to the cylinder portions and shortens the response time involved in changing the position of the ink transfer rollers. The passageways communicating with the cylinder portions and all made equal in length obviate the likelihood that the response time in changing the position of the ink transfer roller will vary from roller to roller.

Not only each of the movable members has a groove extending over the entire length thereof and formed in a surface thereof slidable in contact with the support member and defining the rectangular bore, but the support member also has a groove formed in a surface thereof opposed to the groove of the movable member, and the switching valve is positioned in the grooves and mounted on the support member on a bottom surface defining its groove and facing the groove of the movable member. Accordingly, in a direction orthogonal to the direction of movement of the movable member, the support member is given a width which is increased by an amount corresponding to the wall portions at opposite sides of the support member groove. The support member can therefore be enhanced in flexural rigidity in its entirely, permitting the vibrating roller to be pressed into contact with the fountain roller and the distributing roller with an increased pressure.

The exhaust port of each switching valve may be left opened as it is to the atmosphere, or made to communicate with the atmosphere by way of the passageway formed in the support member.

For example, the cylinder portion is formed by boring the support member in a surface thereof toward said one side in said width direction and has the piston slidably inserted therein, the piston being projectable from the support member to bias the movable member toward said one side in said width direction when air is supplied to the cylinder portion, the support member being formed with a spring cavity in a surface thereof toward said other side in said width direction, the cavity having a biasing member slidably inserted therein and having inserted therein the spring for causing the biasing member to bias the movable member toward said other side in said width direction.

The cylinder portion and the spring cavity are then easy to form, and the support member is simplified in the structure providing the cylinder portion and the piston and also in the structure providing the biasing member. The piston, the spring and the biasing member are also easy to install in the support member.

Useful as the biasing member is, for example, a ball, pin or the like.

For example in this case, each movable member is formed with a recess in a surface thereof defining the rectangular bore and opposed to the piston and a recess in a surface thereof defining the rectangular bore and opposed to the biasing member, the movable member being positioned in place relative to the support member axially thereof by the piston partly fitting in the recess opposed thereto and by the biasing member partly fitting in the recess opposed thereto.

When the movable members are thus positioned in place relative to the support member axially thereof, each pair of adjacent movable members, as well as each pair of adjacent vibrating rollers, can be axially spaced apart by a suitable clearance to render these rollers smoothly movable relative to each other. Further since the movable member can be positioned in place by the piston and the biasing member for use in switching the position of the movable member, there is no need to use additional parts for positioning the movable member, hence a reduced number of components.

For example in this case, a projection can be formed on the end face of the piston and fitted in the corresponding recess to cause the piston end face around the projection to be pressed against the bore-defining surface of the movable member around this recess. The biasing member, when in the form of a pin, can be similarly constructed. Alternatively, the piston or the biasing member may be tapered at its outer end so that the tapered end is fitted in the recess. When the biasing member is a ball, the outer periphery of the ball is made partly fittable in the recess.

For example in this case, the support member can be internally formed with a passageway for holding the exhaust port of each switching valve in communication with the spring cavity to cause the exhaust port to communicate with the atmosphere through the passageway and the spring cavity.

For example, the communication passageway holding the outlet port of the switching valve in communication with the cylinder portion is formed at a junction thereof with the cylinder portion with a flaring part diametrically enlarged toward the cylinder portion.

The flaring part then diminishes the resistance to the flow of air through the junction between the cylinder portion and the communication passageway, permitting air to flow smoothly from the passageway into the cylinder portion and also from the cylinder portion into the passageway and shortening the response time involved in the pneumatic movement of the piston to result in a shortened response time in switching the position of the ink transfer roller.

For example, a dustproof member in the form of a cylinder and made of a rubberlike elastic material is fitted around end portions of each pair of adjacent movable members to interconnect the end portions.

The dustproof member then precludes ink, dust or the like from ingressing into the interior of the movable members. The dustproof member, which is made of rubberlike elastic material, elastically deforms when the adjacent movable members move individually to absorb the movement, consequently allowing the movable members to move individually to switch the vibrating rollers individually between the two positions.

For example in this case, inward flange portions formed at opposite ends of the dustproof member are fitted in respective annular grooves formed in the outer peripheral surfaces of the movable members, whereby the dustproof member can be fixed to the movable members. The dustproof member can be secured to the outer peripheral surfaces of the movable members alternatively as by adhering its opposite ends thereto.

BEST MODE OF CARRYING OUT THE INVENTION

The best mode of carrying out the invention will be described below with reference to the drawings.

Figure 1:
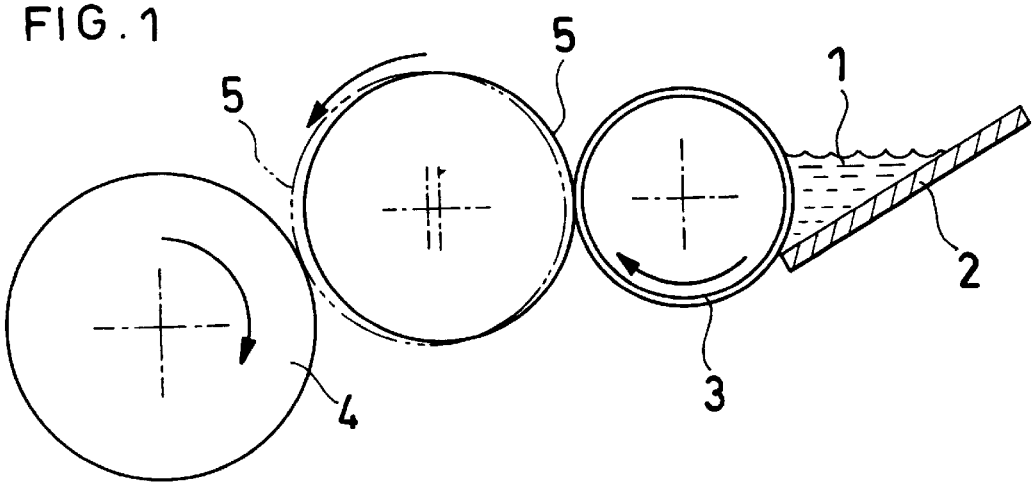
FIG. 1 is a schematic side elevation of an inking arrangement for printing presses which is an embodiment of the invention.
Figure 3:
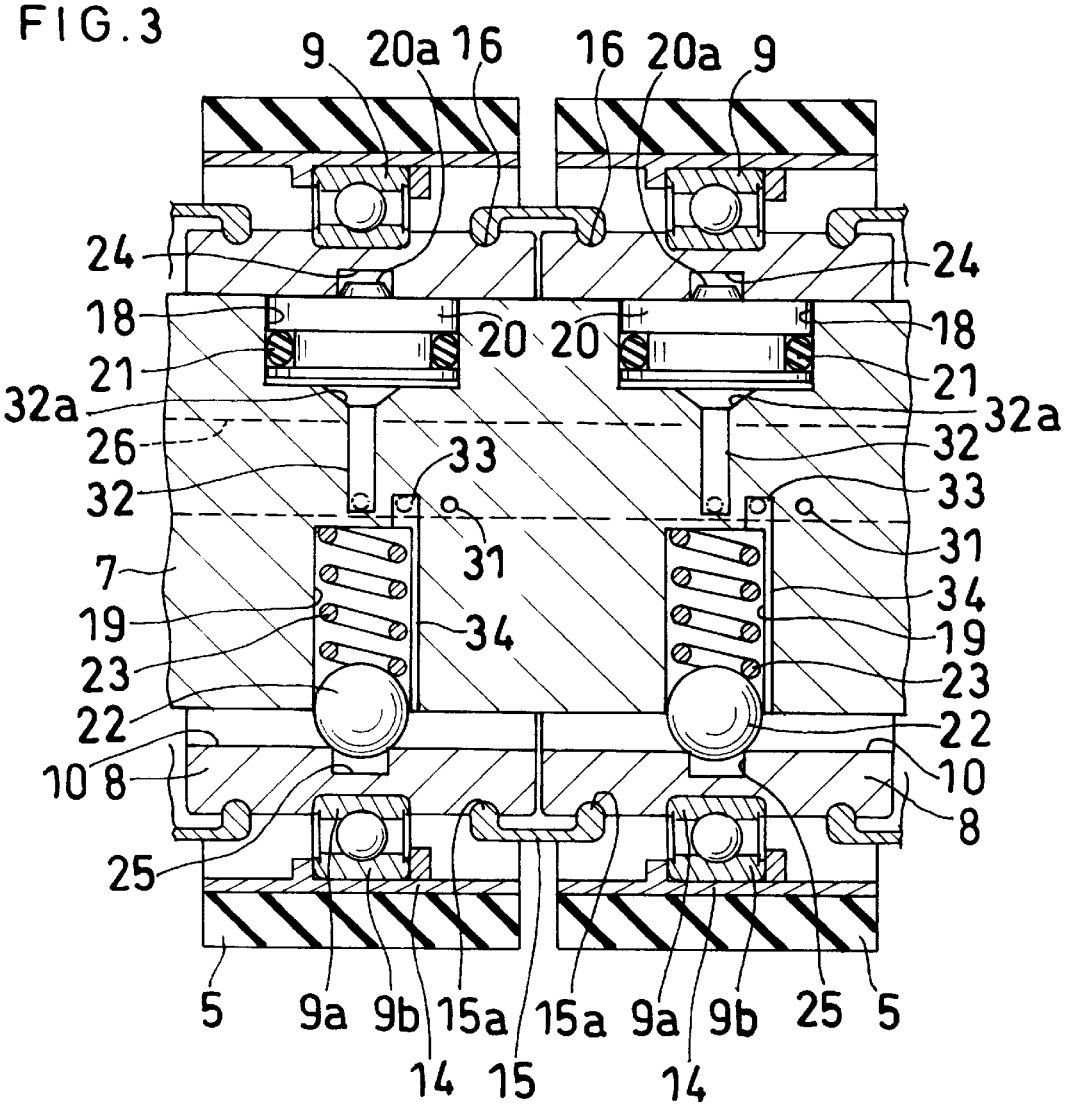
FIG. 3 is an enlarged view in section taken along the line III—III in FIG. 2.
Figure 2:
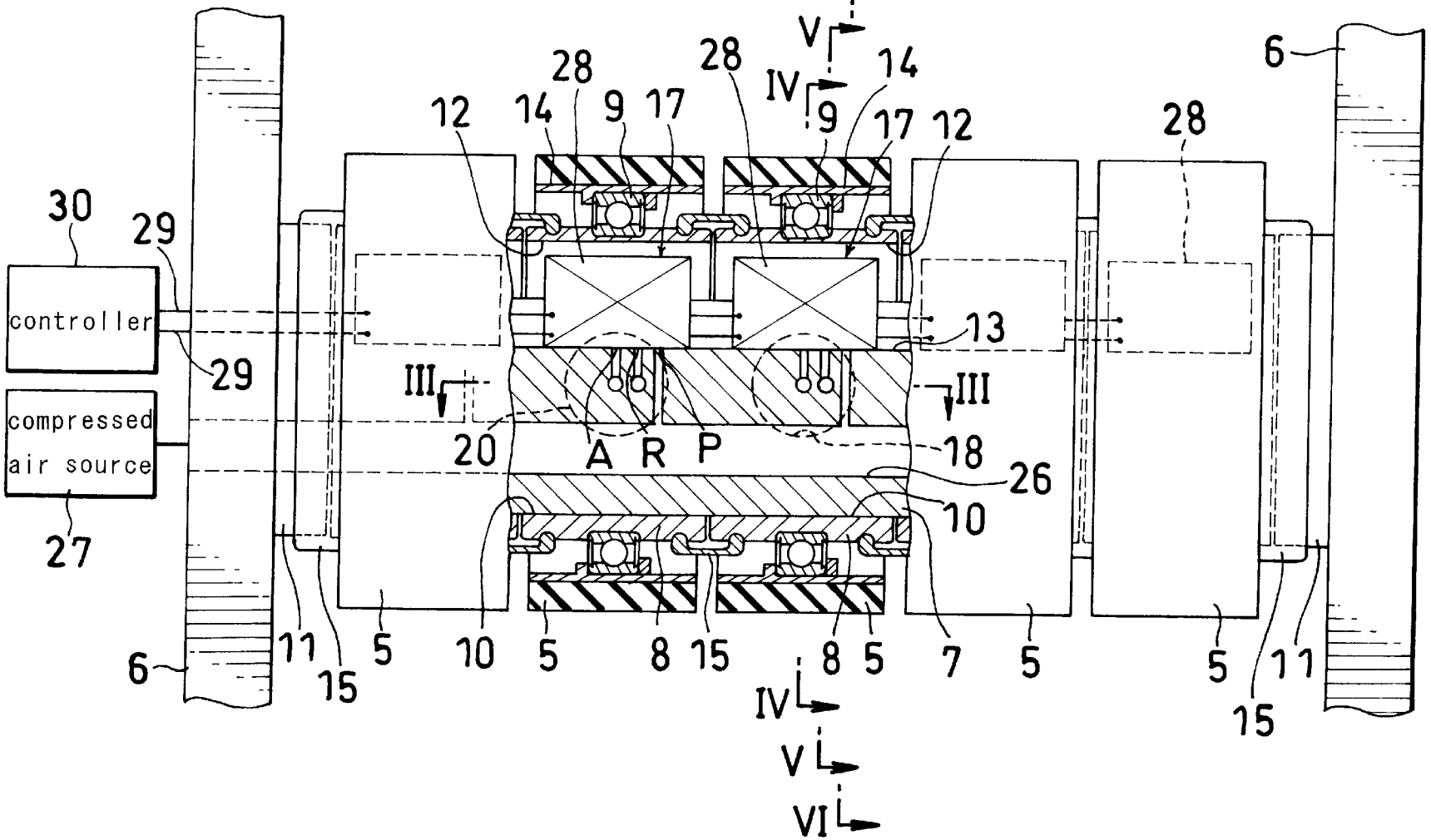
FIG. 2 is a front view partly broken away and showing an assembly of vibrating rollers shown in FIG.

FIG. 1 schematically shows part of an inking arrangement for printing presses, and FIGS. 2 to 6 show the main portion of the same on an enlarged scale. In the following description, the right-hand side of FIG. 1 and FIGS. 4 to 6 will be referred to as the "front," the left-hand side thereof as the "rear," and the terms "left" and "right" will be used for the arrangement as it is seen from the front rearward, thus referring respectively to the left-hand side and the right-hand side of FIGS. 2 and 3.

The arrangement has an ink quantity adjusting plate (doctor blade) 2 providing the bottom of an ink fountain 1, a fountain roller 3 proximate to the plate 2, and the first 4 of a plurality of distributing rollers to the rear of the fountain roller 3. Between the fountain roller 3 and the distributing roller 4, a plurality of vibrating rollers 5 divided axially of these rollers 3, 4 are arranged at an interval in the axial direction. The fountain roller 3 and the distributing roller 4 are rotatably supported by a frame 6 of the press so as to be parallel to each other and are rotated by an unillustrated drive device in the respective directions of arrows in FIGS. 1 and 4 at predetermined speeds as timed with each other.

The vibrating rollers 5 are provided around a support member 7 fixed to the frame 6, each by a movable member 8 and a ball bearing 9, in the following manner so as to be parallel to the fountain roller 3 and the distributing roller 4.

The support member 7 is in the form of a prism having a front-to-rear width slightly greater than the vertical width thereof and has its opposite ends secured to the frame 6. The movable member 8 is in the form of a short cylinder and has a rectangular bore 10 axially extending therethrough. The movable members 8 are arranged in the axial direction between a pair of opposed short cylindrical fixing members 11 secured to the frame 6 and having the support member 7 extending therethrough. The support member 7 extends through the bores 10 of the movable members 8. The vertical width of the bore 10 of the movable member 8 is approximately equal to the vertical width of the support member 7, and the upper and lower surfaces defining the bore 10 are slidable in contact with the respective upper and lower surfaces of the support member 7. The front-to-rear width of the bore 10 is slightly greater than the front-to-rear width of the support member 7. The movable member 8 is movable forward and rearward relative to the support member 7 between a front limit position where the rear surface of the bored portion 10 is in contact with the rear surface of the support member 7 and a rear limit position where the front surface of the bored portion 10 is in contact with the front surface of the support member 7.

The movable members 8 are positioned in place relative to the support member 7 axially thereof, with a small axial clearance formed between the movable members 8 and also between each end movable member 8 and the fixing member 11. Accordingly, the movable members 8 are individually movable forward and rearward relative to the support member 7.

The movable member 8 has a rectangular groove 12 extending over the entire length thereof and formed in the upper surface thereof which is slidable in contact with the support member 7 and defines the bore 10. The support member 7 has a rectangular groove 13 extending over the entire length thereof and formed in its upper surface facing the groove.

The inner ring 9*a* of the bearing 9 is fixed to the outer periphery of each movable member 8, and the vibrating roller 5 in the form of a rubber cylinder of large wall thickness is fixedly fitted around a metal sleeve 14 secured to the outer ring 9*b* of the bearing 9.

A dustproof member 15 in the form of a short cylinder is fitted around outer peripheral portions of each pair of adjacent movable members 8 to interconnect these portions. The dustproof member 15 is made of a suitable rubberlike elastic material such as natural rubber, synthetic rubber or synthetic resin and has a flange portion 15*a* slightly bulging inward from each of its opposite ends. The flange portions 15*a* are fitted in annular grooves 16 formed in the outer peripheral surfaces of the movable members 8, whereby the dustproof member 15 is fixed to the movable members 8. Although not shown in detail, like dustproof member 15 is fitted also around outer peripheral portions of the movable member 8 at each of left and right ends and the fixing member 11 adjacent thereto to interconnect these portions.

A change-over device 17 for the vibrating roller 5 is provided between each movable member 8 and the support member 7 in the following manner, as mounted on the support member 7. The portion of the support member 7 corresponding to the midportion of the movable member 8 with respect to the axial direction is formed with a cylinder portion 18 extending from the rear surface forward a short distance, and a spring cavity 19 extending from the front surface rearward a short distance. The center of the cylinder portion 18 and the center of the spring cavity 19 are positioned on a forward or rearward straight line in the vicinity of the center of the movable member 8 with respect to the vertical direction. A piston 20 in the form of a short solid cylinder is inserted in the cylinder portion 18 forwardly and rearwardly slidably, with an O-ring 21 fitted therein around the piston. Inserted in the spring cavity 19 are a ball 22 serving as a biasing member and slidable forward and rearward, and a compression coil spring 23 for biasing the ball forward.

The rear surface of the bored portion 10 of the movable member 8 facing the center of the piston 20 and the front surface of the bored portion 10 facing the center of the ball 22 are formed with respective recesses 24, 25. The recesses 24, 25 have a definite width axially of the movable member 8. The recesses 24, 25 are uniformly shaped in section orthogonal to the axis of the movable member 8 and are each in the form of a circular arc centered about a straight line parallel to the axis. A tapered projection 20*a* is formed at the center of the piston 20 on the end face thereof opposed to the recess 24, and is fitted in the recess 24. The length of the portion of piston 20 other than the projection 20*a* is slightly shorter than the length of the cylinder portion 18, such that even when the piston 20 is in the most retracted position within the cylinder portion 18, a major portion of the projection 20*a* projects from the rear surface of the support member 7. On the other hand, the outer periphery of the ball 22 is partly fitted in the recess 25.

At the front portion of the support member 7, the ball 22 is always pressed into contact with the front surface of the bored portion 10 of the movable member 8 by the elastic force of the spring 23. More specifically stated, the outer periphery of the ball 22 is partly pressed against the front and rear edges of the front recessed part 25 of the bored portion 10. At the rear portion of the support member 7, on the other hand, the rear surface of the support member 7 or the piston 20 is pressed into contact with the rear surface of the bored portion 10 of the movable member 7. When the piston 20 is in pressing contact with the rear surface of the bored portion 10, the projection 20*a* is fitted in its entirety in the recess 24, and the end face of the piston 20 around the projection 20*a* is pressed against the rear surface of the bored portion 10 of the movable member 8 around the recess 24, in the case where the maximum outside diameter of the projection 20*a* (the outside diameter of its base end) is equal to or slightly smaller than the axial width of the recess 24, or a major portion of the projection 20*a* except for its base end portion is fitted in the recess 24, with the base end portion of the projection 20*a* pressed against the front and rear edges of the recessed part 24, in the case where the maximum outside diameter of the projection 20*a* is slightly larger than the axial width of the recess 24. When the rear surface of the support member 7 is pressed into contact with the rear surface of the bored portion 10 of the movable member 8, the piston 20 is retracted into the cylinder portion 18, whereas since a major portion of the projection 20*a* on the piston 20 is projected from the rear surface of the support member 7 at all times as stated above, the major portion of the projection 20*a* other than its base end portion is fitted in the recess 24. The movable member 8 is positioned in place axially thereof relative to the support member 7 by the major portion of the projection 20*a* of the piston 20 and part of the ball 22 fitting in the respective recesses 24, 25 at all times.

The support member 7 has an air supply channel 26 extending from its left end axially thereof and closed in the vicinity of its right end, and the open left end of the channel 26 is held in communication with a compressed air source 27 by suitable piping.

Figure 7:
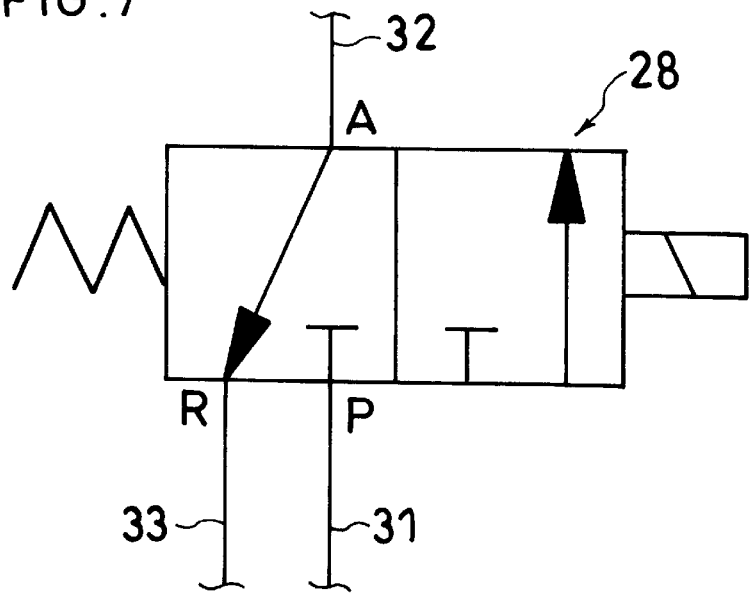
FIG. 7 is a diagram for illustrating a switching valve.

A switching valve 28 is mounted on the support member 7 on the bottom surface of its groove 13 facing the groove 12 of each movable member 8, and is positioned inside the grooves 12, 13. The vertical width of the support member 7 is therefore greater than that of the conventional one by an amount corresponding to the dimension of the projecting wall portions at the front and rear sides of the groove 13. Electric wires 29 for the valves 28 extend through the grooves 12, 13 to the outside and are connected to a controller 30. The switching valve 28 is a three-port two-position solenoid operated directional control valve as shown in FIG. 7 and has at its bottom three ports A, R and P which are arranged from left rightward at a predetermined spacing. When the valve 28 is in an unenergized state (off state), the valve 28 is changed over to the position shown in FIG. 7, in which the inlet port P is held out of communication with the outlet port A, with the outlet port A in communication with the exhaust port R. When the valve 28 is in an energized (on state), the valve 28 is changed over to a position reverse to that shown in FIG. 7, in which the outlet port A is held out of communication with the exhaust port R, with the inlet port P in communication with the outlet port A.

The support member 7 is internally formed with a first passageway 31 for causing the air supply channel 26 to communicate with the inlet port P of the valve 28, a second passageway 32 for causing the outlet port A of the valve 28 to communicate with the cylinder portion 18, and a third passageway 33 for causing the exhaust port R of the valve 28 to communicate with the spring cavity 19. The first passageway 31 extends vertically downward from the inlet port P to a forward portion of the air supply channel 26. The second passageway 32 extends vertically downward and then horizontally rearward and communicates with the front-end center part of the cylinder portion 18. The horizontal portion of the second passageway 32 is formed, at the junction thereof with the cylinder portion 18, with a flaring part (enlarged part) 32*a* diametrically enlarged toward the cylinder portion 18. Although flaring straight in section according to the present embodiment, the enlarged part 32*a* may be flared as curved. The third passageway 33 extends vertically downward from the exhaust port R and then horizontally forward and communicates with the spring cavity 19 at the right edge part thereof. The right side wall defining the horizontal portion of the third passageway 33 is positioned rightwardly (outwardly) of the right wall defining the spring cavity 19. The right wall defining the cavity 19 is formed with an air release groove 34 extending forward over the entire length of the cavity in the form of a forward extension of the horizontal portion of the third passageway 33. When the valve 28 is in the off state, the inlet port P is held out of communication with the outlet port A, so that the cylinder portion 18 is cut off from the air supply channel 26, with the outlet port A in communication with the exhaust port R. As a result, the cylinder portion 18 communicates with the atmosphere via the second passageway 32, valve 28, third passageway 33 and spring cavity 19. Conversely when the valve 28 is in the on state, the outlet port A is held out of communication with exhaust port R, cutting off the cylinder portion 18 from the atmosphere, and the inlet port P communicates with the outlet port A, permitting the cylinder portion 18 to communicate with the air supply channel 26 via the second passageway 32 and the valve 28.

With the inking arrangement described, the energization state of the valves 28 of the change-over devices 17 is changed by the controller 30, whereby the movable members 8 are switched between the front limit position and the rear limit position, consequently switching the vibrating rollers 5 between a first position where the rollers 5 are in contact with the fountain roller 3 and away from the distributing roller 4 and a second position where the rollers 5 are in contact with the distributing roller 4 and away from the fountain roller 3.

Figure 4:
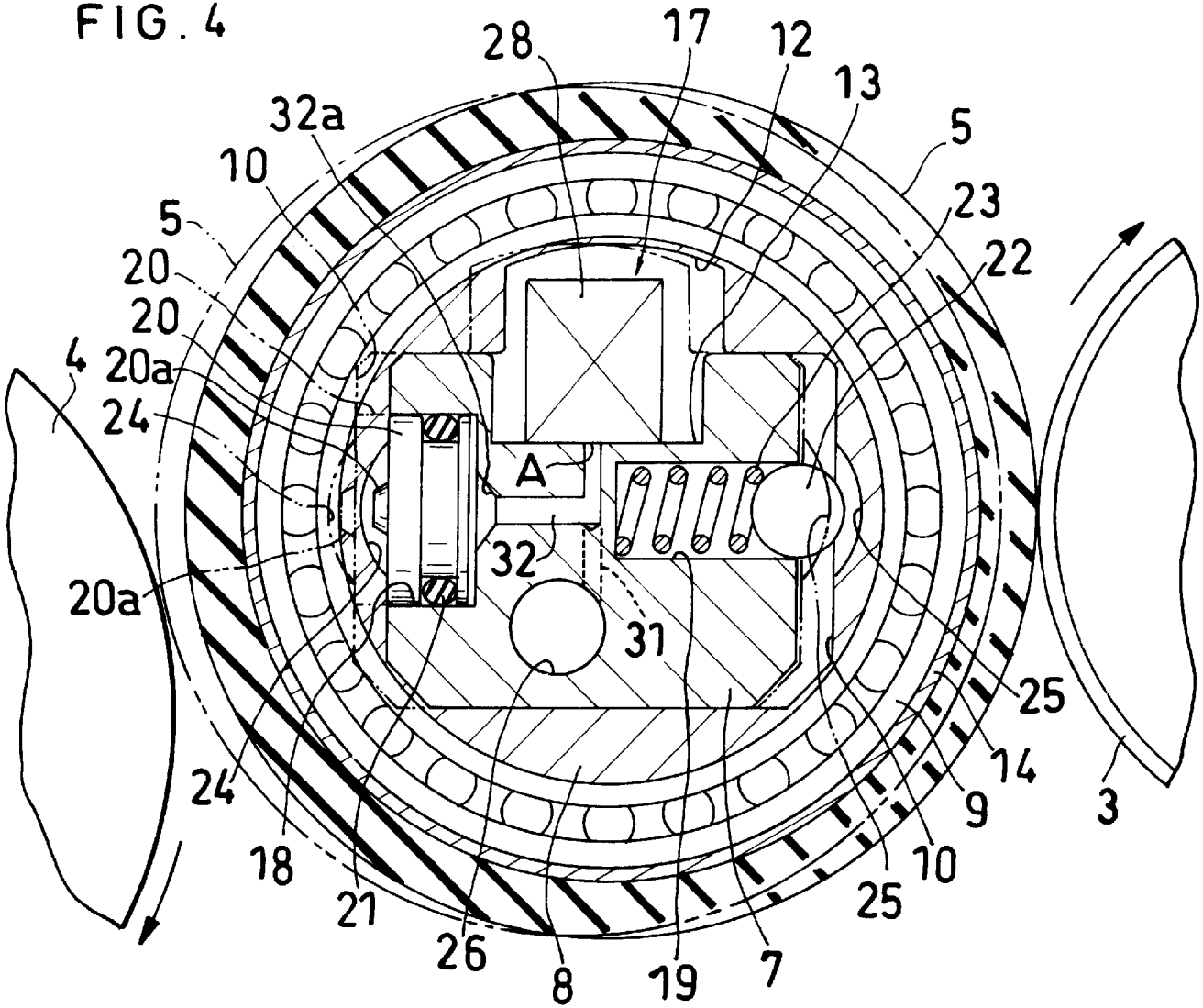
FIG. 4 is an enlarged view in section taken along the line IV—IV in FIG. 2.
Figure 5:
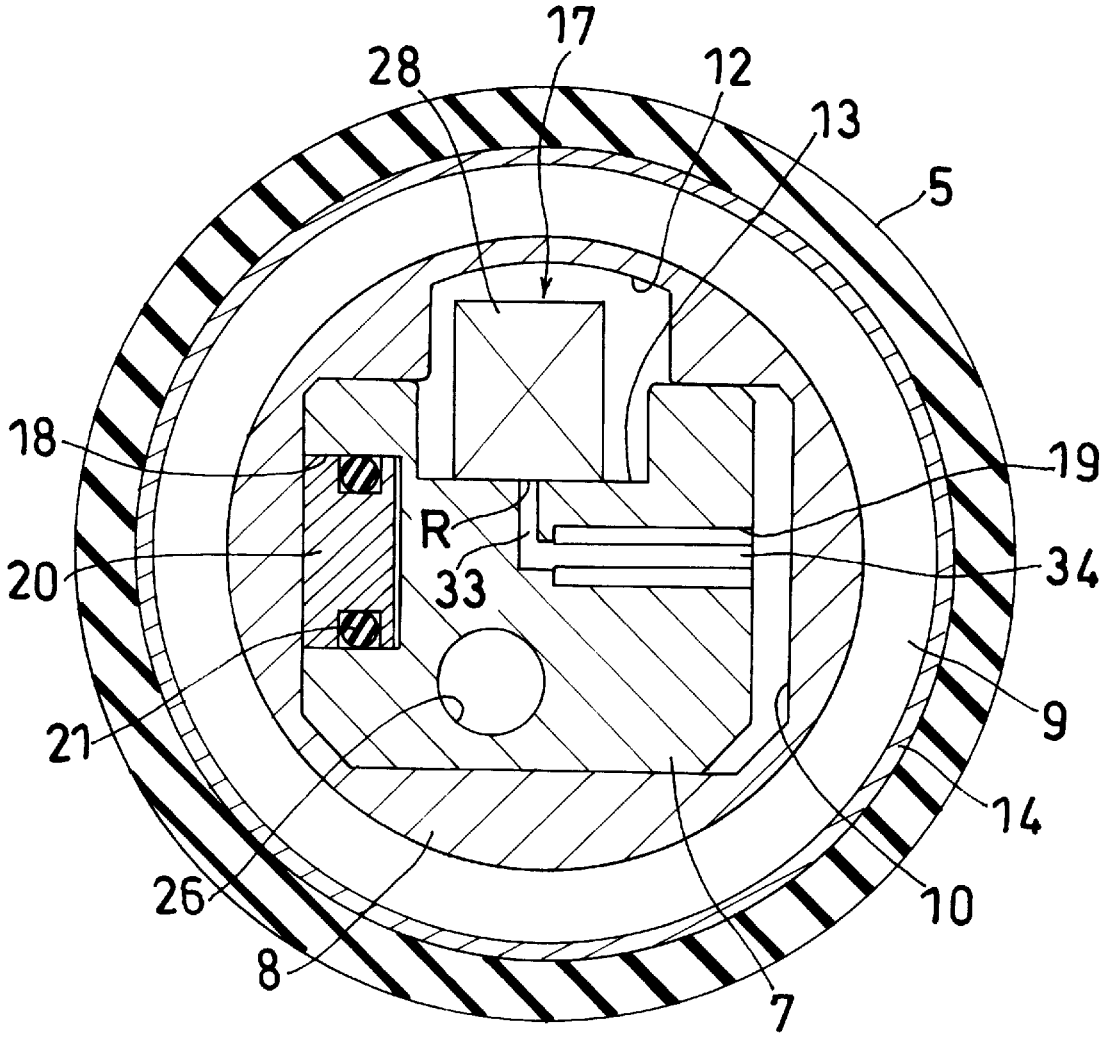
FIG. 5 is an enlarged view in section taken along the line V—V in FIG. 2.
Figure 6:
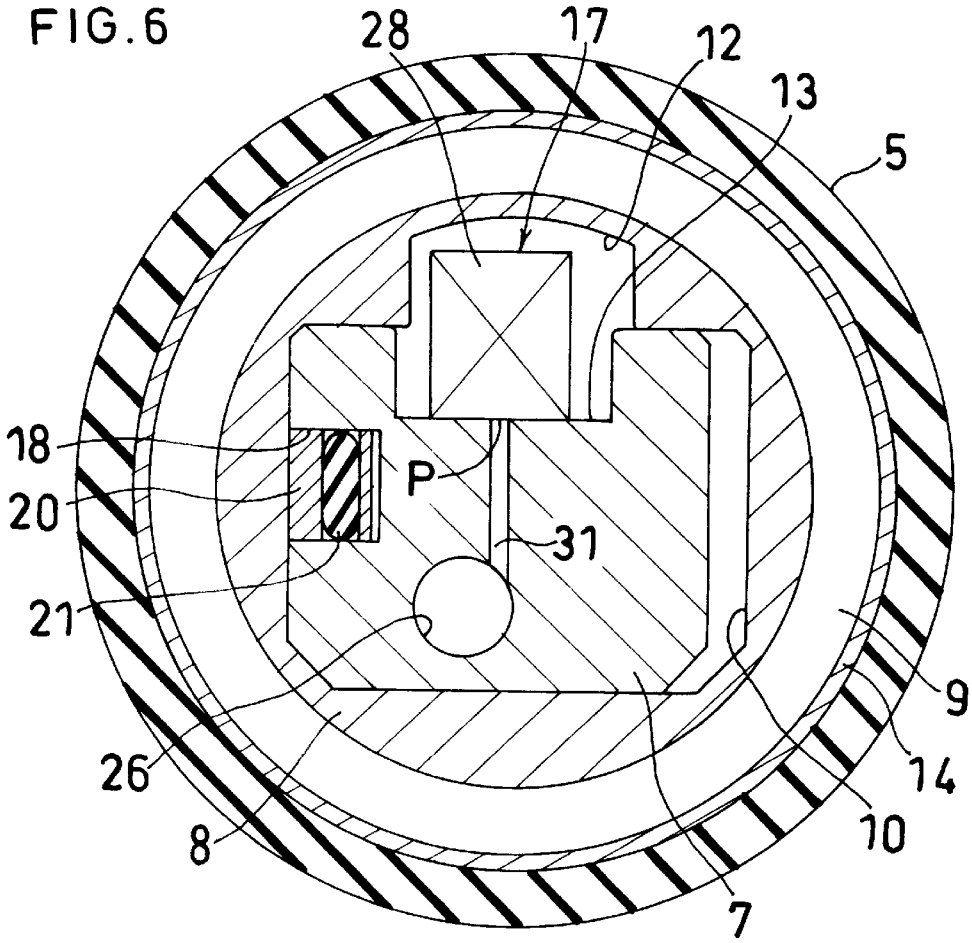
FIG. 6 is an enlarged view in section taken along the line VI—VI in FIG. 2.

FIG. 4 shows the valve 28 as changed over to the off state. At this time, the cylinder portion 18 is cut off from the air supply channel 26 and in communication with the atmosphere, so that the movable member 7 is held at rest in its front limit position in which the rear surface of the support member 7 is in pressing contact with the rear surface of the bored portion 10 of the movable member 8 by being biased forward by the elastic force of the spring 23. As a result, the vibrating roller 5 is switched to the first position at the front limit and pressed against the fountain roller 3. The vibrating roller 5 is rotated in the direction of arrow in FIG. 4 by the frictional force of the fountain roller 3. While the piston 20 is in its retracted position within the cylinder portion 18 at this time, a major portion of the projection 20*a* projects from the rear surface of the support member 7 to fit in the recess 25 as previously described, positioning the movable member 8 in place with respect to the axial direction thereof. The front end face of the piston 20 is in contact with or in the vicinity of the front end wall of the cylinder portion 18, and the volume of the cylinder portion 18 is nearly zero or greatly diminished.

When the valve 28 in this state is switched to the on state, the cylinder portion 18 is cut off from the atmosphere and communicates with the air supply channel 26, whereby compressed air is supplied from the air source 27 to the cylinder portion 18 by way of the air supply channel 26, valve 28 and second passageway 32. The air pressure pushes the piston 20 out from the support member 7 rearward against the elastic force of the spring 23, moving the movable member 8 rearward and eventually bringing the member 8 to a halt at the rear limit position where the front surface of the support member 7 is in pressing contact with the front surface of the bored portion 10 of the movable member 8. Consequently, the vibrating roller 5 is switched to the second position at the rear limit and pressed against the distributing roller 4 as indicated in a chain line in FIG. 4. The vibrating roller 5 is rotated in the direction of arrow in FIG. 4 by the frictional force of the distributing roller 4. When the compressed air flows into the cylinder portion 18 from the second passageway 32 initially, the front end face of the piston 20 is positioned in proximity to the front end wall of the cylinder portion 18, greatly diminishing the volume of the cylinder portion 18 as previously stated, so that if the second passageway 32 directly communicates with the cylinder portion 18 without the intervening enlarged part 32*a*, the air encounters increased resistance to the inflow, failing to flow into the cylinder portion 18 smoothly and consequently resulting in a prolonged response time in switching the position of the movable member 8, i.e., of the vibrating roller 5. With the inking arrangement described, however, the second passageway 32 is formed, at the unction thereof with the cylinder portion 18, with the enlarged part 32*a* flaring toward the cylinder portion 8. The resistance to the inflow of air is therefore small from the beginning, permitting the air to flow into the cylinder portion 18 smoothly and consequently shortening the response time in switching the position of the movable member 8, i.e., of the vibrating roller. With the movable member 8 switched to the rear limit position, the ball 22 is retracted in the spring cavity 19 but is pressed against the front surface of the bored portion 10 of the movable member 8 by the elastic force of the spring 23, positioning the movable member 8 in place axially thereof.

When the valve 28 is changed over from this state to the off state, the cylinder portion 18 is cut off from the air supply channel 26 and communicates with the atmosphere, so that the movable member 8 is moved forward by the elastic force of the spring 23 and eventually brought to a halt at the front limit position in which the rear surface of the support member 7 is in pressing contact with the rear surface of the bored portion 10 of the movable member 8. As a result, the vibrating roller 5 is switched to the first position. The forward movement of the movable member 8 causes the rear surface of the bored portion 10 to push the piston into the cylinder portion 18, whereby the air in the cylinder portion 18 is discharged to the atmosphere through the second passageway 32, valve 28, third passageway 33 and spring cavity 19. The resistance offered to the outflow of air from the cylinder portion 18 to the second passageway 32 is small since the enlarged part 32*a* is formed at the junction therebetween, permitting the air to flow out into the second passageway 32 smoothly. Even if the clearance in the spring cavity 19 around the ball 22 is very small, the air release groove 34 formed in the peripheral wall defining the cavity 19 provides an air discharge passage between the wall and the ball 22, obviating the likelihood of the ball 22 impeding the discharge of the air to the atmosphere. This renders the piston 20 smoothly movable, shortening the response time in switching the position of the movable member 8, i.e., of the vibrating roller 5.

Ink is brought out of the ink fountain 1 through a clearance between the fountain roller 3 and the adjusting plate 2 onto the surface of the roller. At this time, the thickness of film of the ink, i.e. the quantity of the ink, egressing to the surface of the fountain roller 3 is controllable by adjusting the clearance between the roller 3 and the plate 2. The ink brought to the surface of the fountain roller 3 is transferred to each vibrating roller 5 while the roller 5 is switched to the first position, and the ink transferred to the roller 5 is transferred to the distributing roller 4 while the roller 5 is switched to the second position. The lengths of time during which each vibrating roller 5 is held in the first position and the second position are controlled by the controller 30, whereby the quantity of ink to be supplied to the printing surface is adjusted from position to position widthwise of the paper.

The components of the inking arrangement are not limited to those of the foregoing embodiment in construction but can be modified suitably. According to the embodiment, the vibrating roller 5 is switchable between a position where the roller 5 is in contact with the fountain roller 3 and away from the distributing roller 4 and a position where the roller 5 is in contact with the distributing roller 4 and away from the fountain roller 3, whereas the present invention is applicable also to inking arrangements wherein the vibrating roller as held in contact with the distributing roller at all times can be switched between a position in contact with the fountain roller and a position away from the fountain roller as disclosed, for example, in JP-A No. 301439/1990.

INDUSTRIAL APPLICABILITY

The present invention is applicable to inking arrangements for use in printing presses. More particularly, the invention is applicable to an inking arrangement for printing presses which comprises a fountain roller, a distributing roller and a plurality of vibrating rollers divided axially of the rollers and arranged therebetween, the vibrating rollers being individually switchable back and forth between two positions between the fountain roller and the distributing roller so as to differ in the mode of contact thereof with these two rollers.

What is claimed is:

1. An inking arrangement for printing presses which comprises a fountain roller and a distributing roller supported by a frame so as to be parallel to each other, and a plurality of vibrating rollers divided axially of these rollers and arranged at an interval axially thereof between the rollers, the vibrating rollers being individually switchable between two positions between the fountain roller and the distributing roller so as to differ in the mode of contact thereof with the rollers, the inking arrangement further comprising a support member in the form of a prism and secured to the frame so as to be parallel to the fountain roller and the distributing roller, a plurality of short cylindrical movable members fitted around the support member, each of the movable members being formed with a rectangular bore having the support member inserted therethrough with a clearance provided in the bore in the direction of one width of the support member, the vibrating rollers being rotatably mounted on the respective movable members externally thereof, and change-over devices provided on the support member and positioned between the support member and the respective movable members for moving the respective movable members along said direction of width of the support member to switch the vibrating rollers individually between said positions, each of the change-over devices comprising a piston slidably inserted in a cylinder portion for pneumatically biasing the movable member toward one side in said width direction, a spring for biasing the movable member toward the other side in said width direction, and a switching valve having an inlet port, an outlet port and an exhaust port communicating with a compressed air source, the cylinder portion and the atmosphere respectively for controlling supply of air to the cylinder portion when changed in the energization state thereof, the movable member being switchable to said one side in the width direction by the biasing force of the piston when air is supplied to the cylinder portion, the movable member being switchable to said other side in the width direction by the biasing force of the spring when no air is supplied to the cylinder portion, the inking arrangement being characterized in that:

each of the movable members has a groove extending over the entire length thereof and formed in a surface thereof slidable in contact with the support member and defining the rectangular bore, the support member having a groove formed in a surface thereof opposed to the groove of the movable member, the switching valve being positioned in the grooves and mounted on the support member on a bottom surface defining its groove and facing the groove of the movable member, the support member being bored to provide the cylinder portion, the support member being internally formed with a common air supply channel extending through the support member axially thereof and communicating at one end thereof with the compression air supply source, a plurality of communication passageways each holding the air supply channel in communication with the inlet port of the switching valve, and a plurality of communication passageways each holding the outlet port of the switching valve in communication with the cylinder portion.

2. An inking arrangement for printing presses according to claim 1 which is characterized in that the cylinder portion is formed by boring the support member in a surface thereof toward said one side in said width direction and has the piston slidably inserted therein, the piston being projectable from the support member to bias the movable member toward said one side in said width direction when air is supplied to the cylinder portion, the support member being formed with a spring cavity in a surface thereof toward said other side in said width direction, the cavity having a biasing member slidably inserted therein and having inserted therein the spring for causing the biasing member to bias the movable member toward said other side in said width direction.

3. An inking arrangement for printing presses according to claim 2 which is characterized in that the movable member is formed with a recess in a surface thereof defining the rectangular bore and opposed to the piston and a recess in a surface thereof defining the rectangular bore and opposed to the biasing member, the movable member being positioned in place relative to the support member axially thereof by the piston partly fitting in the recess opposed thereto and by the biasing member partly fitting in the recess opposed thereto.

4. An inking arrangement for printing presses according to any one of claims 1 to 3 which is characterized in that the communication passageway holding the outlet port of the switching valve in communication with the cylinder portion is formed at a junction thereof with the cylinder portion with a flaring part diametrically enlarged toward the cylinder portion.

5. An inking arrangement for printing presses according to any one of claims 1 to 3, which is characterized in that a dustproof member in the form of a cylinder and made of a rubberlike elastic material is fitted around end portions of each pair of adjacent movable members to interconnect the end portions.

* * * * *